US005499483A

United States Patent [19]

Oikawa

[11] Patent Number: 5,499,483

[45] Date of Patent: Mar. 19, 1996

[54] COIN WRAPPING APPARATUS

[75] Inventor: Yoshio Oikawa, Okegawa, Japan

[73] Assignee: Laurel Bank Machines Co., Ltd., Tokyo, Japan

[21] Appl. No.: 355,234

[22] Filed: Dec. 9, 1994

[30] Foreign Application Priority Data

Dec. 17, 1993 [JP] Japan ..... 5-317194

[51] Int. Cl.[6] ..... B65B 11/04; B65B 57/10; B65B 57/20

[52] U.S. Cl. ..... 53/53; 53/54; 53/212; 53/500

[58] Field of Search ..... 53/53, 54, 500, 53/212, 532, 254

[56] References Cited

U.S. PATENT DOCUMENTS

| | | | |
|---|---|---|---|
| 4,058,954 | 11/1977 | Asami | 53/54 |
| 4,123,892 | 11/1978 | Asami | 53/54 |
| 4,162,598 | 7/1979 | Watanabe et al. | 53/54 |
| 4,195,463 | 4/1980 | Bergman et al. | 53/54 X |
| 4,353,195 | 10/1982 | Nakamura | 53/54 |
| 4,845,917 | 7/1989 | Omura et al. | 53/53 |
| 4,852,253 | 8/1989 | Uchida | 30/2 |

FOREIGN PATENT DOCUMENTS

| | | |
|---|---|---|
| 2644753 | 4/1977 | Germany . |
| 4006060 | 8/1990 | Germany . |
| 61-19483 | 5/1986 | Japan . |

*Primary Examiner*—James F. Coan
*Attorney, Agent, or Firm*—Cushman, Darby & Cushman

[57] ABSTRACT

A coin wrapping apparatus includes a coin discriminating and counting section which discriminates deposited coins as to whether or not they are genuine and their denomination agrees with a predetermined one while counting the number of coins, a coin stacking section which stacks a predetermined number of coins of predetermined denomination to be wrapped, wrapping rollers which wind a wrapping film whose width is wider than a height of coins stacked in the coin stacking section around the stacked coins so that there remain crimp regions above and below the stacked coins, upper crimp claw and lower crimp claw, movable in the vertical direction toward each other so that the stacked coins are held therebetween, for crimping the crimp regions to generate rolls of wrapped coins, discrepancy detecting device for detecting as to whether or not the predetermined number of stacked coins are wrapped after the wrapping film is wrapped around the stacked coins by the wrapping roller, rolls of wrapped coins collecting box for collecting the rolls of wrapped coins, cutter which cuts the wrapping film when it is detected that the number of stacked coins wrapped with the wrapping film is less than or more than the predetermined number of coins, coin collecting box for collecting the coins whose wrapping film is cut by the cutter, and gate for selectively delivering the coins to the rolls of wrapped coins collecting box or the coin collecting box in accordance with the detected result by the detecting device for detecting discrepancy in number of coins.

22 Claims, 9 Drawing Sheets

COIN WRAPPING APPARATUS

BACKGROUND OF THE INVENTION

The present invention relates to a coin wrapping apparatus, and, more particularly, to a coin wrapping apparatus which is capable of collecting the wrapped stacked coins with more than or less than the predetermined number of coins separately from those with the predetermined number of coins.

DESCRIPTION OF THE PRIOR ART

In a coin wrapping machine in general, the genuineness and denominations of coins deposited thereinto are discriminated and the number of coins of the denomination to be wrapped is counted. Then, every predetermined number of such coins of the denomination to be wrapped is fed to a coin stacking section where they are stacked in a roll-form and the predetermined number of roll-like stacked coins are further fed to a coin wrapping section. In the coin wrapping section, the stacked coins are rotated, while being supported by a supporting bar and held between a plurality of wrapping rollers, whereby a wrapping film made of, for example, paper, or semi-transparent or transparent plastics having a larger width than the height of the stacked coins is wound around the stacked coins in such a manner that there remain above and below the stacked coins crimp regions of the wrapping film which are to be crimped. A pair of an upper crimp claw and a lower crimp claw spaced in the vertical direction move toward each other, thereby crimping the crimp regions of the wrapping film above and below the stacked coins and producing a wrapped roll-like stacked coins.

Therefore, the predetermined number of stacked coins should be always fed from the coin stacking section to the coin wrapping section. However, the number of stacked coins fed to the coin wrapping section may sometimes be less than the predetermined number of coins, since some of the stacked coins may sometimes drop out when the stacked coins are fed from the coin stacking section to the coin wrapping section, or the number of stacked coins fed to the coin wrapping section may be sometimes more than the predetermined number of coins, since for some reason, some of the stacked coins remain in the coin stacking section without feeding to the coin wrapping section and, whereby the remaining coin or coins are fed to the coin wrapping section together with the coins stacked in the coin stacking section in the next coin wrapping operation cycle.

In order to prevent the stacked coins with more than or less than the predetermined number of coins from being wrapped, Japanese Patent publication No. Sho 61-19483 proposes a coin wrapping apparatus which judges whether or not the predetermined number of coins are stacked based on the distance the claw supporting arms move toward each other when both edges of the wrapping film wrapped around the stacked coins are crimped after the stacked coins are transferred to the coin wrapping section. When the wrapping procedure is completed, the rolls of the wrapped stacked coins with the predetermined number of coins are collected in a rolls of wrapped coins collecting box while the rolls of the wrapped stacked coins with more than or less than the predetermined number of coins are collected in a separate box.

In accordance with such coin wrapping apparatus, the rolls of wrapped stacked coins with more than or less than the predetermined number of coins can be collected separately from those with the predetermined number of coins. However, after the operator takes the rolls of the wrapped stacked coins with more than or less than the predetermined number of coins out of the box, they can be hardly distinguished from those rolls with the predetermined number of coins since they are all wrapped in the same manner. Therefore, there is a risk of mixing them up by mistake.

SUMMARY OF THE INVENTION

It is, therefore, an object of the present invention to provide a coin wrapping apparatus which is capable of distinguishing the wrapped stacked coins with more than or less than the predetermined number of coins from those rolls of wrapped stacked coins with the predetermined number of coins without fail.

The above and other objects of the present invention can be accomplished by a coin wrapping apparatus comprising a coin discriminating and counting means for discriminating deposited coins as to whether or not they are genuine and their denomination agrees with a predetermined one while counting the number of coins, a coin stacking means for stacking a predetermined number of coins of predetermined denomination to be wrapped, wrapping roller means for winding a wrapping film whose width is wider than a height of coins stacked in the coin stacking section around the stacked coins so that there remain crimp regions above and below the stacked coins, upper crimp claw means and lower crimp claw means, movable in the vertical direction toward each other so that the stacked coins are held therebetween, for crimping the crimp regions to generate rolls of wrapped coins, discrepancy detecting means for detecting as to whether or not the predetermined number of stacked coins are wrapped after the wrapping film is wrapped around the stacked coins by the wrapping roller means, roll collecting means for collecting the rolls of the wrapped coins, cutting means for cutting the wrapping film when it is detected that the number of stacked coins wrapped with the wrapping film is less than or more than the predetermined number of coins, coin collecting means for collecting the coins whose wrapping film is cut by the cutting means, and gate means for selectively delivering the coins to the roll collecting means or the coin collecting means in accordance with the detected result by the discrepancy detecting means.

In a preferred aspect of the present invention, the cutting means includes a cutter and a solenoid which advances and retracts the cutter toward the stacked coins.

In a further preferred aspect of the present invention, upper claw arm means for supporting the upper crimp claw means and lower claw arm means for supporting the lower crimp claw means, and the cutting means is mounted on one of the upper and lower claw arm means.

In a still further preferred aspect of the present invention, the cutting means includes first spring means and second spring means connected to each other in series, wherein the second spring means is connected at its one end opposite to where the first and second spring means are connected to either of the upper and lower claw arm means, the first spring means is connected at its one end opposite to where the first and second spring means are connected to a rod portion of the solenoid, and the cutter is attached to where the first and second spring means are connected to each other.

In a still further preferred aspect of the present invention, wrapping roller arm means for supporting the wrapping roller means, and the cutting means is mounted on the wrapping roller arm means.

In a still further preferred aspect of the present invention, the cutting means includes first spring means and second spring means connected to each other in series, wherein the second spring is connected at its one end opposite to where the first and second spring means are connected to each other to the wrapping roller arm means, wherein the first spring is connected at its one end opposite to where the first and second spring means are connected to each other to the rod portion of the solenoid, and wherein the cutter is attached to where the first and second spring means are connected to each other.

In a still further preferred aspect of the present invention, the discrepancy detecting means detects as to whether or not the number of coins wrapped is equal to the predetermined number of coins based on the relative travel distances of the upper and lower crimp claw means.

In a still further preferred aspect of the present invention, it is further provided with upper claw arm means for supporting the upper crimp claw means and lower claw arm means for supporting the lower crimp claw means, and wherein the discrepancy detecting means includes a rack extending vertically which is fixed to one of the upper and lower claw arm means, pinion means engageable with the rack means and rotatably mounted on the other one of the lower and upper claw arm means to which the detecting means is not fixed, absolute type rotary encoder means, connected to the pinion means, for outputting absolute position data in accordance with the rotational position, trigger signal output means for outputting a trigger signal when the upper and lower crimp claw means move to their crimp positions where the stacked coins can be held therebetween, detected data memory means for taking and storing absolute position data output from the rotary encoder means and outputting the absolute position data to comparing means when the trigger signal is output from the trigger signal output means, reference data memory means for storing reference data and outputs the reference data to the comparing means, and the comparing means for detecting a discrepancy in number of coins by comparing the absolute position data output from the detected data memory means with the reference data output from the reference data memory means.

In a still further preferred aspect of the present invention, the discrepancy detecting means includes light emitting means for emitting light toward the wrapping film wrapped around the stacked coins, photoelectric conversion means for detecting the reflected light from the stacked coins wrapped with the wrapping film or the reflected light which passes through between stacked coins along the longitudinal axis of the stacked coins and outputting an electric detected signal that is proportional to the amount of detected light, counter means for outputting a detected data generated by counting the number of stacked coins based on the electric detected signal input from the photoelectric conversion means, and comparing means for detecting as to wether or not the number of stacked coins is equal to the predetermined number of coins by comparing the detected data output from the counter means and the reference data stored therein.

In a still further preferred aspect of the present invention, it is further provided with solenoid driving means for driving the solenoid, and gate driving means for switching the gate means, and the solenoid driving means advances the solenoid when the comparing means judges that the number of stacked coins is not equal to the predetermined number of coins while causing the gate driving means to switch the gate means to deliver the coins to the coin collecting means.

The above and other objects and features of the present invention will become apparent from the following description made with reference to the accompanying drawings.

DESCRIPTION OF THE PREFERRED EMBODIMENTS

Figure 1:
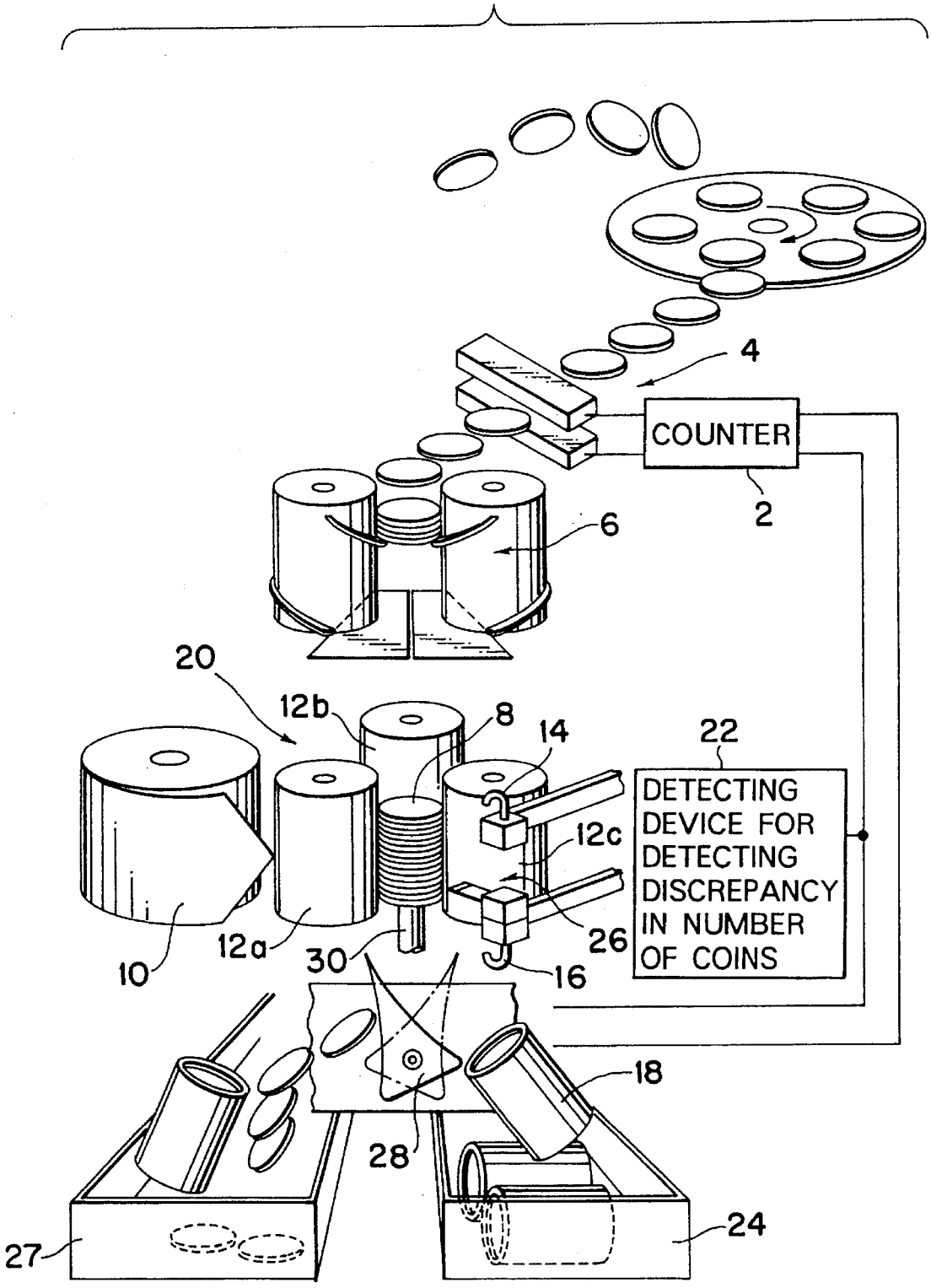
FIG. 1 is a schematic diagram showing a coin stacking section and a coin wrapping section of the coin wrapping apparatus which is a preferred embodiment of the present invention.

The coin wrapping apparatus shown in FIG. 1 is comprised of a coin discriminating and counting section 4 which discriminates the deposited coins as to whether or not they are genuine and their denomination agrees with a predetermined one and provided with a counter 2 which counts the number of coins, a coin stacking section 6 which stacks the predetermined number of coins of the predetermined denomination to be wrapped, wrapping rollers 12*a*, 12*b* and 12*c* by which a wrapping film 10 made of materials such as paper and plastic is wound around stacked coins 8 stacked in a roll-form in the coin stacking section 6, and an upper crimp claw 14 and a lower crimp claw 16 which crimp the upper and lower edges of the wrapping film 10 respectively, a coin wrapping section 20 which generates a wrapped roll of stacked coins 18 comprising the predetermined number of coins wrapped with the wrapping film 10, a detecting device for detecting discrepancy in number of coins 22 which detects as to whether or not the predetermined number of stacked coins 8 are wrapped based on the relative travel distances of the upper and lower crimp claws 14 and 16 at the time of crimping the wrapping film 10, a gate member 28 which delivers the wrapped roll of stacked coins 18 to a rolls of wrapped coins collecting box 24 when the wrapped roll of stacked coins 18 with the predetermined number of stacked coins 8 is generated, or which delivers the coins to a coin collecting box 27 after cutting the wrapping film 10 wrapped around the wrapped stacked coins by a cutting device 26 when the predetermined number of coins are not wrapped.

In such coin wrapping apparatus, the deposited coins are discriminated as to whether or not they are genuine and their denomination agrees with a predetermined one and the number thereof is counted in the coin discriminating and counting section 4 provided with the counter means 2, whereby only the genuine coins of the predetermined denomination are sorted by coin sorting means (not shown) and every predetermined number of them are fed to the coin stacking section 6. In the coin stacking section 6, the coins are stacked in a roll-form by a well known method and the stacked coins 8 in a roll-form is transferred from the coin stacking section 6 to the position on a supporting bar 30. The obtained roll-like stacked coins 8 are transferred to the wrapping position in the coin wrapping section 20, while they are being held on the supporting bar 30. Afterward, they are rotated while being held among three wrapping rollers 12*a*, 12*b* and 12*c* and the wrapping film 10 having a larger width than the height of the stacked coins 8 is fed by wrapping film feed means (not shown) and is wound around the stacked coins 8. Thereafter, crimp regions of the wrapping film 10 remained above and below the stacked coins 8 are crimped by the upper and the lower crimp claws 14 and 16 and at the same time, as described in detail hereinafter, it is detected whether or not the predetermined number of coins are wrapped by the detecting device for detecting discrepancy in number of coins 22. The gate member 28 is normally in the position shown by a solid line in FIG. 1 and the wrapped roll of stacked coins 18 generated with the predetermined number of coins is delivered to the rolls of wrapped coins collecting box 24. On the other hand, when it is detected that more than or less than the predetermined number of coins are wrapped by the detecting device for detecting discrepancy in number of coins 22, the wrapping film 10 wrapped around the stacked coins 8 is cut by the cutting device 26. Then, the gate member 28 is swung to the position shown by a dotted line in FIG. 1 whereby the stacked coins 8 are delivered to the coin collecting box 27 separately from the wrapped roll of stacked coins 18 with the predetermined number of coins.

Figure 2:
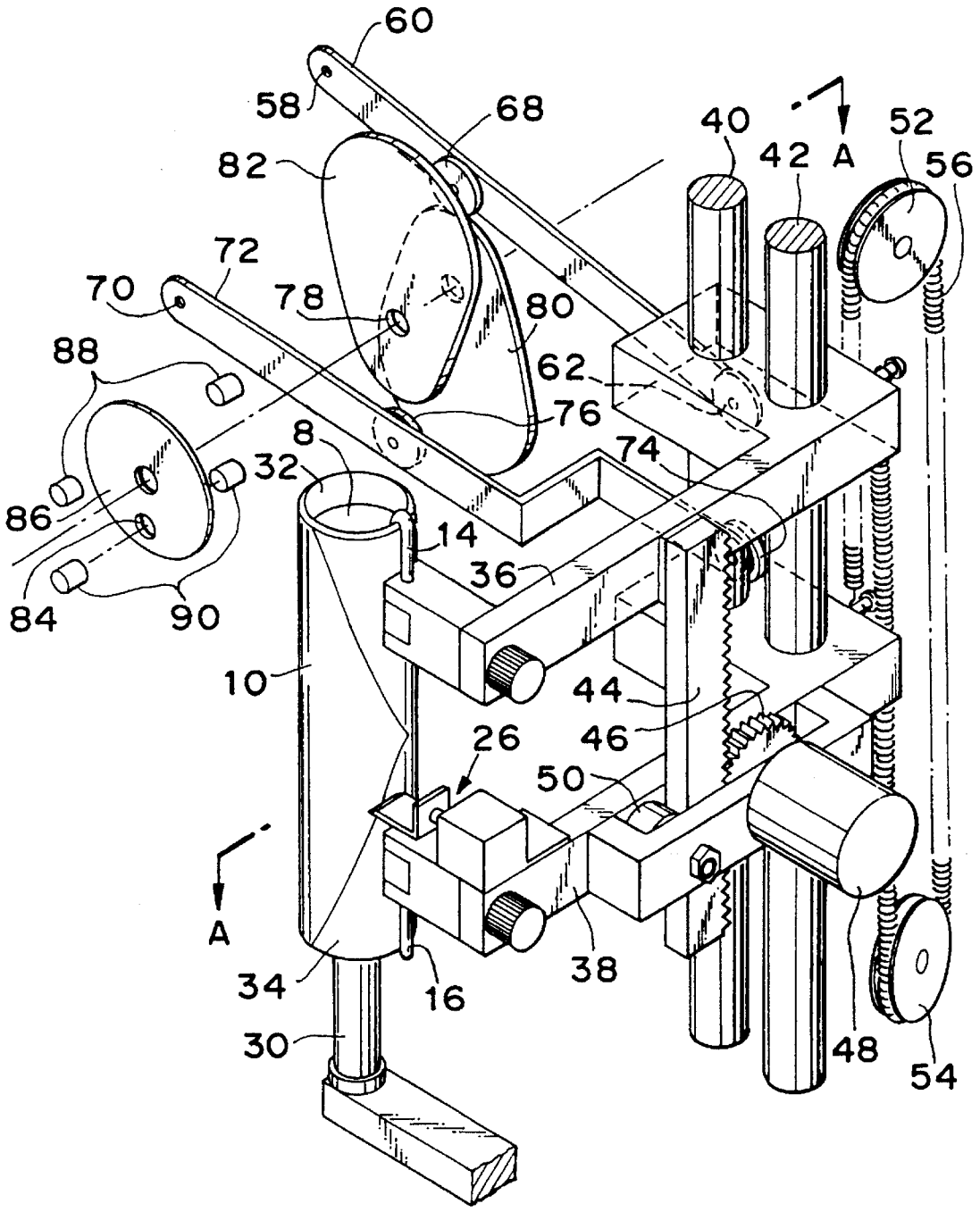
FIG. 2 is a schematic perspective view showing the composition of a coin wrapping section of the coin wrapping apparatus shown in FIG. 1.

FIG. 2 is a schematic perspective view showing the composition of a coin wrapping section of the coin wrapping apparatus shown in FIG. 1.

Referring to FIG. 2, the wrapping film 10 fed by the wrapping film feed means (not shown) has a larger width than the height of the stacked coins 8 and is wound around the stacked coins 8 by the wrapping rollers 12*a*, 12*b*, and 12*c* so that the upper and lower crimp regions 32, 34 are remained above and below the stacked coins 8. A coin wrapping apparatus is provided with the upper crimp claw 14 and the lower crimp claw 16 for crimping the crimp regions 32, 34 of the wrapping film 10 remained above and below the stacked coins 8 to generate the wrapped roll of stacked coins 18 by wrapping the stacked coins 8. The upper crimp claw 14 is fixed to an upper claw arm 36 at its one end and the lower crimp claw 16 is fixed to an lower claw arm 38 at its one end, both of which extend horizontally. In the vicinity of the other ends thereof, the upper and lower claw arms 36, 38 are supported by guide rods 40,42 respectively whereby they can be moved vertically, in other words, they are supported in such a manner which enables to approach toward and separate from each other. The upper and lower claw arms 36, 38 and the guide rod 42 are swingable in the horizontal direction about the guide rod 40 with arms (not shown) mounted on the guide rod 40 at upper and lower ends thereof and swingable about the guide rod 40 so that the upper and the lower crimp claws 14, 16 can be moved to correspond to the diameter of the denomination to be wrapped. The detecting device for detecting discrepancy in number of coins 22 detects whether or not the predetermined number of coins are wrapped by detecting the relative travel distances the upper and lower claw arms 36, 38 moved.

A rack 44 extending vertically is fixed to the upper claw arm 36 to which the upper crimp claw 14 is attached and a pinion 13 engageable with the rack 44 is rotatably mounted on the lower claw arm 38 to which the lower crimp claw 16 is attached, whereby a rack and pinion mechanism is formed. An absolute type rotary encoder 48 is connected to the pinion 46. The reference numeral 50 designates a guide roller for guiding the rack 44, thereby ensuring engagement between the rack 44 and the pinion 46.

The upper claw arm 36 and the lower claw arm 38 are connected by a spring 56 engaged with pulleys 52, 54 and the upper claw arm 36 is biased downwardly and the lower claw arm 38 is biased upwardly by the spring 56.

A roller 62 abuts on the lower face of the upper claw arm 36 in the vicinity of the guide rods 40, 42, the roller 62 being secured to an upper swing arm 60 at its tip end that is swingable about a shaft 58 in the vertical plane, and a cam follower 68 is rotatably mounted on the upper swing arm 60 at substantially the central portion thereof between the shaft 58 and the roller 62. On the other hand, a roller 74 abuts on the upper face of the lower claw arm 38 in the vicinity of the guide rods 40, 42, the roller 74 being secured to a lower swing arm 72 at its tip end that is swingable about a shaft 70 in the vertical plane, and a cam follower 76 is rotatably mounted on the lower swing arm 72 at substantially the central portion thereof between the shaft 70 and the roller 74.

The cam follower 68 of the upper swing arm 60 abuts on the cam lobe of a first cam 80 rotatable about a cam shaft 78 and the cam follower 76 of the lower swing arm 72 abuts on the cam lobe of a second cam 82 rotatable about the cam shaft 78. The first cam 80 and the second cam 82 are connected to each other so as to be rotated together. The profiles of the first cam 80 and the second cam 82 are respectively determined so that each has a cam lobe farthest from the cam shaft 78 and a cam lobe closest to the cam shaft 78 at positions spaced by 180 degrees, and that when the cam follower 68 of the upper swing arm 60 and the cam follower 76 of the lower swing arm 72 respectively abut on the cam lobes furthest from the cam shaft 78, the upper crimp claw 14 is positioned at its uppermost position and the lower crimp claw 16 is positioned at its lowermost position, in other words, they are positioned at their retracted positions, while when the cam follower 68 of the upper swing arm 60 and the cam follower 76 of the lower swing arm 72 respectively abut on the cam lobes closest to the cam shaft 78, the upper crimp claw 14 is positioned at its lowermost position and the lower crimp claw 16 is positioned at its uppermost position. The lowermost position of the upper crimp claw 14 and the uppermost position of the lower crimp claw 16 are set in such a manner that the former can be lower than and the latter can be higher than the positions where the upper crimp claw 14 and the lower crimp claw 16 hold the stacked coins 8 consisting of the predetermined number of coins of a denomination with the smallest thickness to be wrapped by the coin wrapping apparatus therebetween. More specifically, when the upper crimp claw 14 and the lower crimp claw 16 hold the stacked coins 8 therebetween, in other words, when the upper crimp claw 14 and the lower crimp claw 16 have reached their crimp positions, in normal situations, the upper crimp claw 14 cannot be lowered any further and the lower crimp claw 16 cannot be raised any further. However, in the case where one of the upper crimp claw 14 and the lower crimp claw 16 has not moved to its predetermined position for some reason, the other claw is further moved until the upper crimp claw 14 and the lower crimp claw 16 can hold the stacked coins 8 therebetween, whereby it is possible to detect any discrepancy in the number of stacked coins 8 without fail. Accordingly, in normal situations, the upper crimp claw 14 abuts on the upper face of the uppermost coin of the stacked coins 8 to be wrapped and the lower crimp claw 16 abuts on the lower face of the lowermost coin of the stacked coins 8 to be wrapped, even before the cam follower 68 of the upper swing arm 60 and the cam follower 76 of the lower swing arm 72 respectively come into contact with the cam lobes closest to the cam shaft 78. As a result, the upper and lower crimp claws 14, 16, and the upper and lower claw arms 36,38 do not move any more. Then, when the first cam 80 and the second cam 82 are further rotated, the roller 62 departs from the lower face of the upper claw arm 36, while the cam follower 68 of the upper swing arm 60 abuts on the cam lobe of the first cam 80. On the other hand, the cam follower 76 of the lower swing arm 72 departs from the cam lobe of the second cam 82, while the roller 74 abuts on the upper face of the lower claw arm 38. Thus, the engagement between the first cam 80 and the upper claw arm 36 via the upper swing arm 60 and the engagement between the second cam 82 and the lower claw arm 38 via the lower swing arm 72 are released.

As shown schematically in FIG. 2, a disc 86 formed with a light transmission hole 84 and rotatable together with the first cam 80 and the second cam 82 is provided coaxially with the cam shaft 78 and photosensors 88,90, each consisting of a light emitting element and a light receiving element, are disposed to confront the disc 86. The photosensor 88 is disposed so that light emitted from its light emitting element can be received via the light transmission hole 84 by its light receiving element when the cam follower 68 of the upper swing arm 60 and the cam follower 76 of the lower swing arm 72 respectively abut on the cam lobes of the first and second cams 80, 82 furthest from the cam shaft 78 and the photosensor 90 is disposed so that light emitted from its light emitting element can be received via the light transmission hole 84 by its light receiving element when the cam follower 68 of the upper swing arm 60 abuts on the cam lobe of the first cam 80 closest from the cam shaft 78. The photosensors 88, 90 are disposed so as to be spaced from each other by 180 degrees with respect to the rotating direction of the disc 86. Therefore, it can be detected by the photosensor 88 that the upper crimp claw 14 and the lower crimp claw 16 are positioned at their retracted positions. Moreover, when the cam follower 68 of the upper swing arm 60 is on the cam lobe of the first cam 80 closest to the cam shaft 78, then since the upper crimp claw 14 is positioned so as to abut on the upper face of the uppermost coin of the stacked coins 8 to be wrapped and the lower crimp claw 16 is positioned so as to abut on the lower face of the lower most coin of the stacked coins 8 to be wrapped, in other words, they are positioned at their crimp positions, it is possible to detect by the photosensor 90 that the upper crimp claw 14 and the lower crimp claw 16 are positioned at their crimp positions.

As described above, when the first cam 80 and the second cam 82 are rotated by one revolution for wrapping a roll of stacked coins 8, the upper crimp claw 14 and the lower crimp claw 16 are respectively moved from their retracted positions to their crimp positions and returned to their retracted positions and the upper claw arm 36 and the lower claw arm 38 are moved in the vertical direction in accordance with the movement of the upper crimp claw 14 and the lower crimp claw 16. As a result, the pinion 46 rotatably mounted on the lower claw arm 38 is rotated by the rack 44 fixed to the upper claw arm 36 by a distance corresponding to the sum of the travel distances of the upper crimp claw 14 and the lower crimp claw 16 in the vertical direction. Since the absolute type rotary encoder 48 connected with the pinion 46 can output coded absolute position data of a predetermined number of bits in accordance with the position of rotation, it is possible to detect the travel distances of the upper crimp claw 14 and the lower crimp claw 16 in the vertical direction based upon the absolute position data output from the rotary encoder 48. For instance, in the case where a pinion 13 of diameter of 24 mm and a rotary encoder 48 of 8 bits are employed, it is possible to obtain the absolute position data with a resolution of 0.29 mm.

Figure 3:
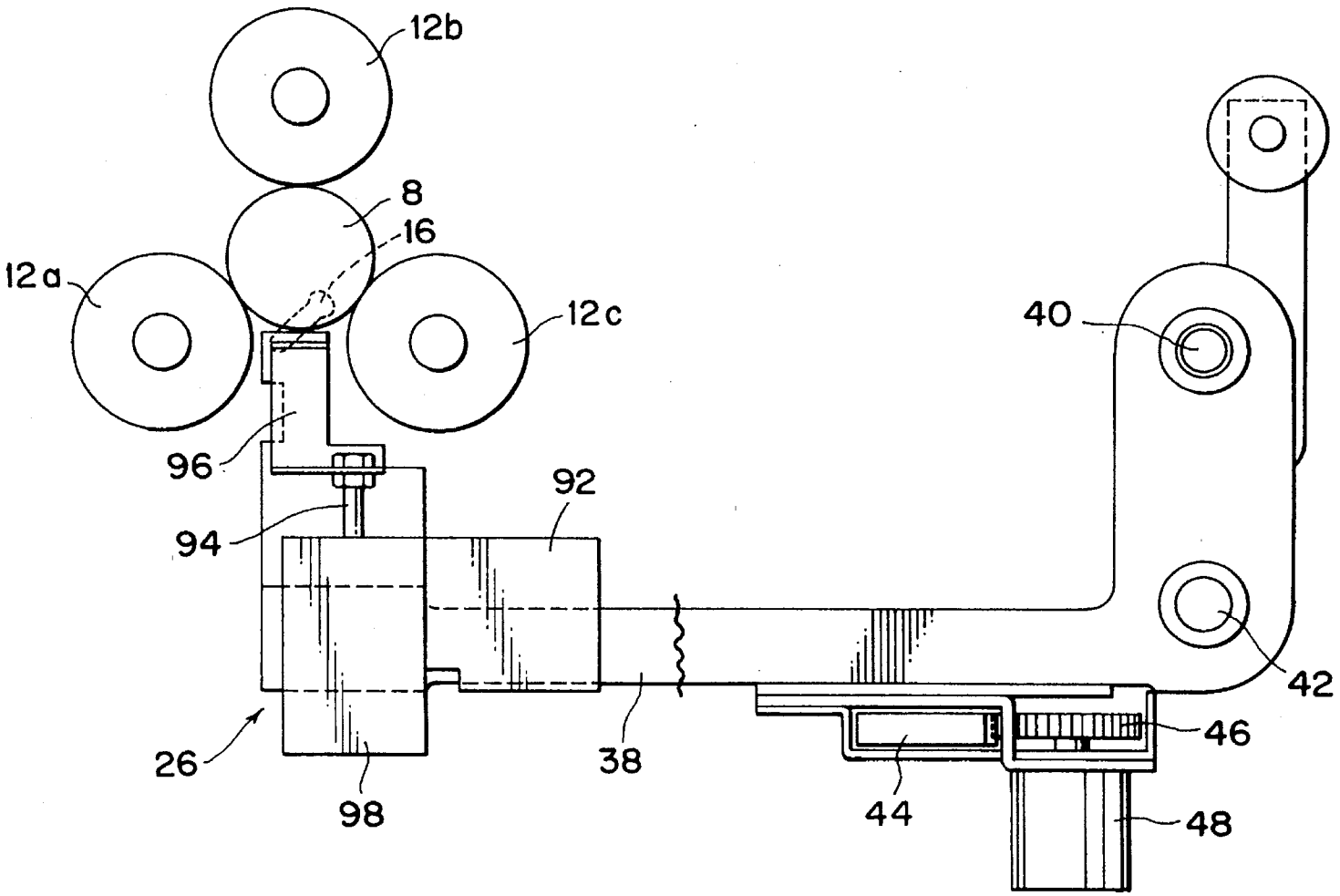
FIG. 3 is a schematic cross-sectional view taken along line A—A of FIG. 2.

FIG. 3 is a schematic cross-sectional view taken along line A—A of FIG. 2.

As shown in FIG. 3, the cutting device 26 is mounted on the lower claw arm 38 at its end in the vicinity of wrapping position by a solenoid attachment plate 92. The cutting device 26 is comprised of a solenoid 98, a cutter 96 for cutting the wrapping film 10 wrapped around the stacked coins 8, which is attached to the rod portion 94 of the solenoid 98 and is movable in the horizontal direction by the solenoid 98. When it is detected that the number of coins wrapped is less than or more than the predetermined number of coins by the detecting device for detecting discrepancy in number of coins 22, a control system (not shown) outputs a solenoid advance signal to solenoid drive means (not shown) in accordance with a detection signal input from the detecting device for detecting discrepancy in number of coins 22 whereby the solenoid 98 is driven. The cutter 96 attached to the rod portion 94 is advanced in the horizontal direction toward the wrapped stacked coins 8 by the solenoid 98 and is urged to the side of the wrapped coins which is rotated by the wrapping rollers 12*a*, 12*b*, and 12*c*, thereby cutting the wrapping film 10 wrapped around the stacked coins 8. After a certain period of time, the control system outputs a solenoid retraction signal to the solenoid drive means based upon which the solenoid 98 retracts the cutter 96 in the reverse direction and holds it at the retracted position.

Figure 4:
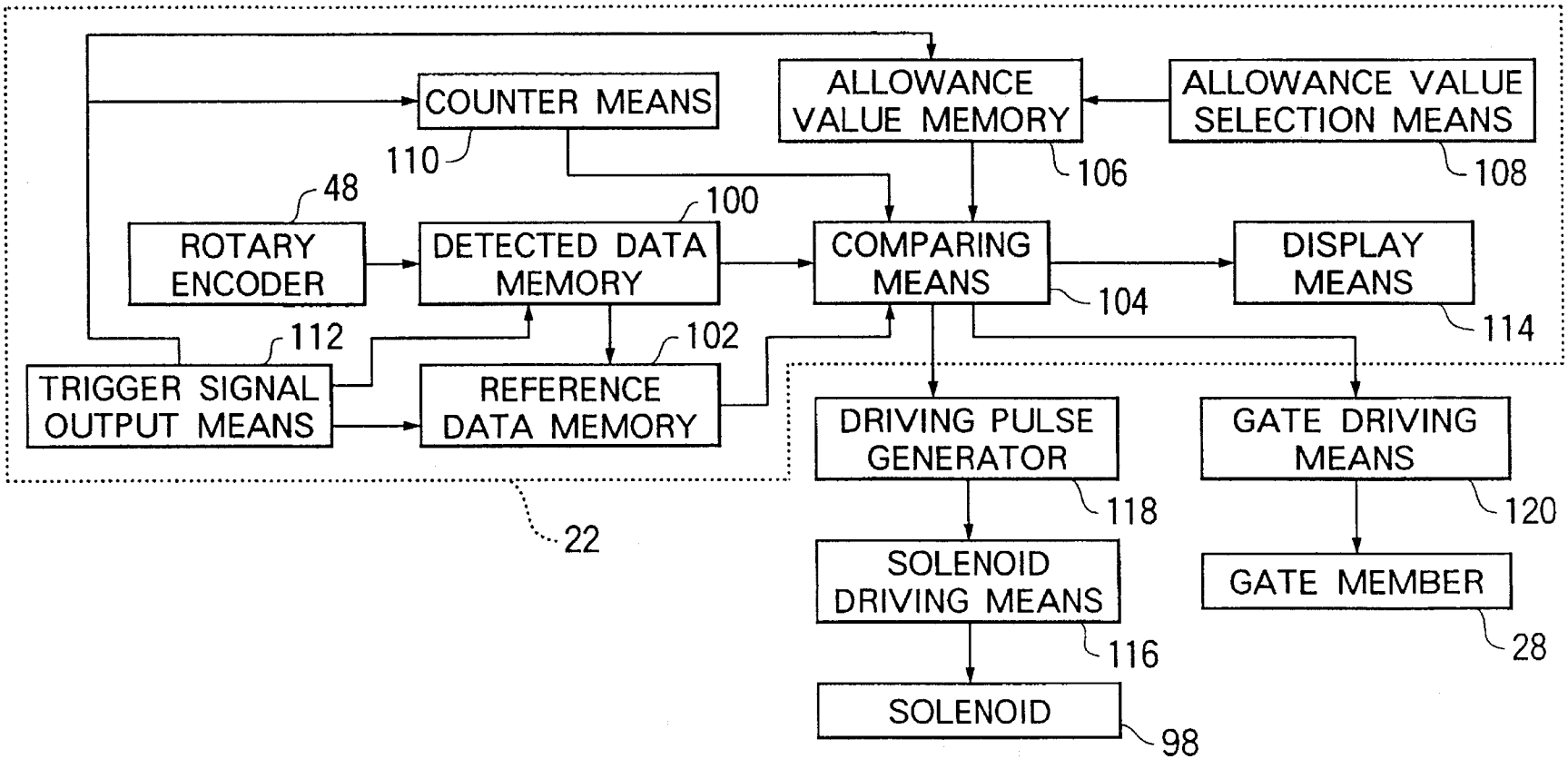
FIG. 4 is a block diagram showing a control system and a judgement system of a discrepancy detecting device and a control system and an operational system of a wrapping film cutting device of the wrapping apparatus.

FIG. 4 is a block diagram showing a control system and a judgement system of a discrepancy detecting device and a control system and an operational system of a wrapping film cutting device of the wrapping apparatus.

In FIG. 4, the control system and the judgement system of the detecting device for detecting discrepancy in number of coins 22 of the coin wrapping apparatus and the control system and the judgement system of the cutting device 26 for cutting the wrapping film 10 comprise a detected data memory 100 for storing absolute position data output from the rotary encoder 48, reference data memory 102 for storing reference data which are to be compared with the absolute position data stored in the detected data memory 100 for judging the discrepancy in the number of stacked coins, comparing means 104 for calculating a difference between the absolute position data output from the detected data memory 100 and the reference data output from the reference data memory 102, and outputting a coincidence signal when it is judged that the calculated difference is not more than an allowance (tolerance) value and outputting a discrepancy signal when it is judged that the difference is more than the allowance value, an allowance value memory 106 for storing allowance values based upon which whether or not there is a discrepancy in the number of stacked coins is judged, allowance value selection means 108 for outputting a selection signal to the allowance value memory 106 based upon an instruction signal input by an operator and selecting an allowance value to be output to the comparing means 104 from among the allowance values stored in the allowance value memory 106, thereby causing the allowance value memory 106 to output the selected allowance value to the comparing means 104, trigger signal output means 112 for outputting a trigger signal to the detected data memory 100, the reference data memory 102, the allowance value memory 106 and counter means 110, when the photosensor 90 detects that the upper crimp claw 14 and the lower crimp claw 16 have reached their crimp positions, thereby causing the detected data memory 100 to store the absolute data being output from the rotary encoder 48 and to output the thus stored absolute position data to the comparing means 104, to cause the reference data memory 102 to output the reference data to the comparing means 104 and to cause the allowance value memory 106 to output the allowance value selected based upon the selection signal input from the allowance value selection means 108 to the comparing means 104 so that the comparing means 104 starts judgment as to whether there is a discrepancy in the number of stacked coins, counter means 110 for receiving a start signal from a wrapping operation start switch (not shown) and the trigger signal from the trigger signal output means 112, counting how many wrapping operations have been completed after the wrapping operation was started and outputting the counted count value to the comparing means 104, and display means 114 for displaying whether or not the number of stacked coins 8 to be wrapped coincides with a predetermined number based upon the coincidence signal or the discrepancy signal output from the comparing means 104, a driving pulse generator 118 for outputting a solenoid advance signal or a solenoid retracting signal to solenoid driving means 116, solenoid driving means 116 for driving the solenoid 98, thereby causing the cutter 96 attached to the tip of the rod portion 94 to be advanced or retracted, and gate driving means 120 for outputting a driving signal to switch the gate member 28 so as to cause the gate member 28 to switch between a reference position shown by a solid line in FIG. 1 and an open position shown by a dotted line, thereby delivering the wrapped roll of stacked coins 18 to the rolls of wrapped coins collecting box 24 when the predetermined number of coins are wrapped or delivering the coins of which the wrapped roll of stacked coins 18 is comprised to the coin collecting box 27 when the wrapped roll of stacked coins 18 has a discrepancy in the number of coins.

In this embodiment, the coin wrapping apparatus is comprised so that the reference data to be stored in the reference data memory 102 is produced based upon the absolute position data input from the rotary encoder 48 to the detected data memory 100 and stored therein. This is because individual coins become thinner due to abrasion through use although the thickness of all coins of the same denomination is initially the same. In fact, the height of the different roll-like stacked coins of the same denomination is not necessarily constant, and, therefore, the accuracy of detection can be improved by producing the reference data based upon the absolute position data for coins actually deposited into the coin wrapping apparatus and comparing them with the absolute position data.

Accordingly, in FIG. 4, the detected data memory 100 includes a memory capable of storing N pieces of absolute position data and the reference data memory 102 also includes a memory capable of storing N pieces of reference data. The detected data memory 100 stores the absolute position data and outputs it to the reference data memory 102 when the absolute position data is input from the rotary encoder 48 thereto. Since the reference data is produced based upon the absolute position data in the above described manner, no reference data is stored in the reference data memory 102 when a first wrapping operation is carried out and, therefore, the discrepancy signal is necessarily output from the comparing means 104 if the detection of a discrepancy in the number of stacked coins by the comparing means 104 is carried out. Accordingly, to avoid such a situation, the counter means 110 judges how many wrapping operation have been completed based upon the start signal from the wrapping operation start switch (not shown) and the trigger signal from the trigger signal output means 112 and outputs the result of the judgement to the comparing means 104, thereby prohibiting the comparing means 104 from detecting discrepancy in the number of stacked coins in the first wrapping operation.

The reference data memory 102 produces the reference data based upon the absolute position data in the following manner and stores it therein and outputs it to the comparing means 104.

More specifically, in the first wrapping operation, since no reference data is stored in the reference data memory 102, the reference data memory 102 outputs zero as the reference data to the comparing means 104 and, on the other hand, the detected data memory 100 stores the absolute position data P1 input from the rotary encoder 48 as an acceptable absolute position data M1 and outputs the absolute position data M1 to the reference data memory 102 where the absolute position data M1 input from the detected data memory 100 is stored as the reference data R.

$$R=M1$$

As described above, in this case, although the absolute position data P1 is input from the detected data memory 100 to the comparing means 104, it does not detect discrepancy in the number of stacked coins.

In the second wrapping operation, the reference data memory 102 outputs the reference data R stored in the first wrapping operation to the comparing means 104. The comparing means 104 calculates the difference between the input reference data R and the absolute position data P2 input from the detected data memory 100 and judges whether or not the absolute value thereof falls within an allowance value A.

As a result, in the case where the comparing means 104 judges that the absolute value of the difference between the reference data R and the absolute data P2 is not more than the allowance value A, it outputs the coincidence signal to the display means 14, the detected data memory 100, and the reference data memory 102 respectively. When the detected data memory 100 receives the coincidence signal from the comparing means 104, it stores the absolute position data P2 input from the rotary encoder 48 as an acceptable absolute position data M2 and outputs the absolute position data M2 to the reference data memory 102. When the reference data memory 102 receives the coincidence signal from the comparing means 104, it calculates the reference data R in accordance with the following formula and stores it in place of the reference data which has been stored therein.

$$R=(M1+M2+(M1+M2)/2)/3$$

On the contrary, in the case where the comparing means 104 judges that the absolute value of the difference between the reference data R and the absolute position data P2 is more than the allowance value A, it outputs the discrepancy signal to the detected data memory 100, the reference data memory 102 and the display means 114 respectively. When the detected data memory 100 receives the discrepancy signal from the comparing means 104, it rejects to store the absolute position data P2 input from the rotary encoder 48 as an unacceptable absolute position data and, on the other hand, when the reference data memory 102 receives the discrepancy signal from the comparing means 104, it does not carry out the renewal operation of the reference data R.

Assuming that by the time an i-th wrapping operation has been completed, the comparing means 104 has detected a discrepancy in the number of stacked coins j times and outputted the discrepancy signal j times, wherein j is zero or a positive integer and less than i and N is not more than the difference (i–j), the reference data R to be output from the reference data memory 102 to the comparing means 104 for i-th detection operation of discrepancy in the number of stacked coins is represented by the following formula.

$$R=(Sk+Sk/k)/(k+1) \quad (1)$$

wherein k=i–j, $$Sk=M1+M2+\ldots+Mk$$

In this manner, the reference data memory 102 produces the reference data R based upon the absolute position data P1,P2, . . . Pi output from the rotary encoder 48 to the detected data memory 100, stores them therein and outputs them to the comparing means 104 where any discrepancy in the number of stacked coins is detected by comparing the absolute value of the difference between the absolute position data and the reference data with the allowance value A.

After (i–j) becomes equal to N, the reference data memory 102 replaces Mn by $Mn=M_{n+1}$ (n=1,2,3, . . . ,N–1) every time it receives the coincidence signal from the comparing means 104 and renews and stores the reference data R in accordance with the formula (1) and outputs them to the comparing means 104 to detect any discrepancy in the number of stacked coins.

In the coin wrapping apparatus in accordance with this preferred embodiment, when the number of coins wrapped is less than or more than the predetermined number of coins, the coins are collected as stated hereinafter.

When the photosensor 90 detects that the upper and lower crimp claws 14, 16 moved from the retracted position and reached the crimp positions, the detected signal is output from the photosensor 90 to the trigger signal output means 112 and the trigger signal output means 112 outputs the trigger signal to the detected data memory 100, the reference data memory 102 and the allowance value memory 106 based on the detected signal. When the trigger signal is received from the trigger signal output means 112, the detected data memory 100 stores the absolute position data output from the rotary encoder 48 and at the same time, it outputs the absolute position data to the comparing means 104. Furthermore, receiving the trigger signal from the trigger signal output means 112, the reference data means 102 outputs the reference data to the comparing means 104. At the same time, the allowance value memory 106 outputs the allowance value selected from among the allowance values stored therein in accordance with the selection signal input from the allowance value selection means 108. The comparing means 104 calculates the difference between the absolute position data input from the detected data memory 100 and the reference data input from the reference data memory 102 and judges whether or not the absolute value of the difference is not more than the allowance value input from the allowance value memory 106. As a result, when it is judged that the absolute value of the difference between the absolute position data and the reference data is not more than the allowance value, the comparing means 104 outputs the coincidence signal to the detected data memory 100, the reference data memory 102 and the display means 114, thereby causing the display means 114 to display that the number of stacked coins 8 to be wrapped coincides with the predetermined number of coins. On the other hand, when it is judged that the the absolute value of the difference between the absolute position data and the reference data is more than the allowance value, the comparing means 104 outputs the discrepancy signal to the detected data memory 100, the reference data memory 102 and the display means 114, thereby causing the display means 114 to display that the number of stacked coins 8 to be wrapped does not coincide with the predetermined number of coins. At the same time, the comparing means 104 outputs the activating signal to the driving pulse generator 118. Receiving the activating signal from the comparing means 104, the driving pulse generator 118 outputs the solenoid advance signal to the solenoid driving means 116. Receiving the solenoid advance signal from the driving pulse generator 118, the solenoid driving means 116 drives the solenoid 98, thereby advancing the cutter 96 to urge it to the side of the stacked coins 8 wrapped with the wrapping film 10. Since the stacked coins 8 wrapped with the wrapping film 10 is held and rotated by the wrapping rollers 12*a*, 12*b* and 12*c*, the wrapping film 10 is cut by the cutter 96 along its periphery. Furthermore, the comparing means 104 outputs the diving signal to the gate driving means 120 and switch the gate member 28 to the open position shown by a dotted line in FIG. 1. As a result, each of the rolls of the wrapped coins with more than or less than the predetermined number of coins is unwrapped and the coins are collected in the coin collecting box 27 guided by the gate member 28. After a certain period of time after the solenoid advancing signal is output to the solenoid driving means 116, the comparing means 104 outputs the activating signal to the driving pulse generator 118 causing it to output the solenoid retracting signal to the solenoid driving means 116. As a result, the solenoid 98 is driven, thereby causing the cutter 96 to be retracted and returned to the initial position.

In accordance with the preferred embodiment, since the wrapping film 10 wrapped around the stacked coins 8 is cut by the cutter 96 and the coins are always collected within the coin collecting box 27 when the number of coins wrapped is less than or more than the predetermined number of coins, the wrapped coins with more than or less than the predetermined number of coins can be distinguished from the wrapped roll of stacked coins 18 with the predetermined number of coins without fail.

Furthermore, even though there is a difference in the diameter among the coins of the denominations to be wrapped, the crimp claws 14, 16 are comprised in such a manner that they swing about the guide rod 40 so that they move to the position corresponding to the diameter of the coins of the denomination to be wrapped. Since the cutting device 26 which is mounted on the lower claw arm 38 is also moved therewith so that it approaches to the position close to the wrapping film 10 wrapped around the stacked coins 8, the distance between the tip of the cutter 96 at the retracted position and the wrapping film 10 is the same regardless of the denomination of the coins. Therefore, without the means for adjusting the distance that the cutter 96 moves, it makes it possible to cut the wrapping film 10 by the cutter 96 in case of wrapping the coins of various denominations and collect the coins with more than or less than the predetermined number of coins within the coin collecting box 27 without fail.

Figure 5:
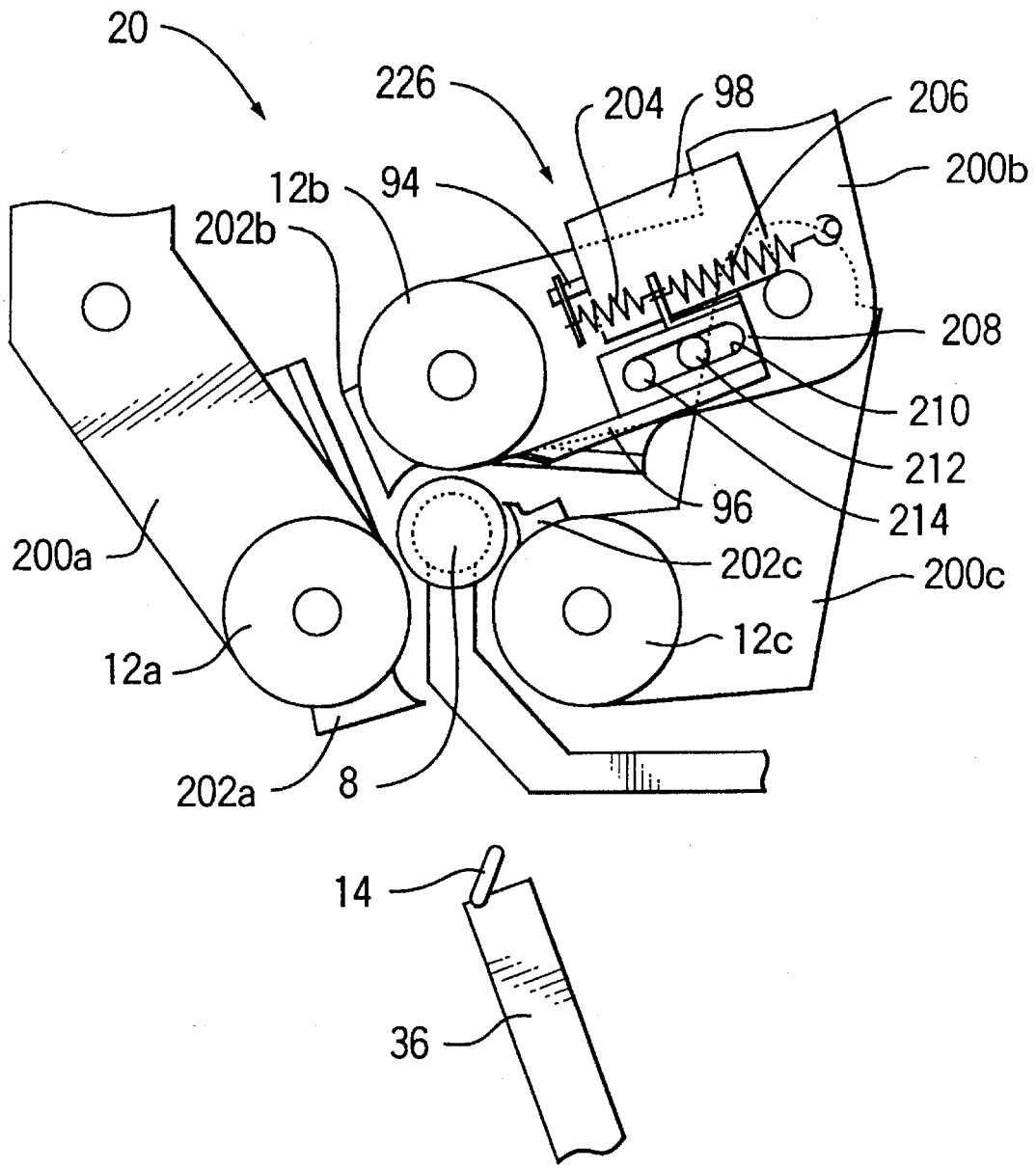
FIG. 5 is a schematic plan view of a wrapping film cutting device and the section where the wrapping film cutting device is mounted of the coin wrapping apparatus which is another preferred embodiment of the present invention.

FIG. 5 is a schematic plan view of a wrapping film cutting device and the section where the wrapping film cutting device is mounted of the coin wrapping apparatus which is another preferred embodiment of the present invention.

In FIG. 5, the coin wrapping section 20 of the coin wrapping apparatus according to another preferred embodiment is comprised of the wrapping rollers 12*a*, 12*b*, and 12*c* which wrap the wrapping film 10 (not shown in FIG. 5) around the stacked coins 8, the wrapping roller arms 200*a*, 200*b*, 200*c* on which the wrapping rollers 12*a*, 12*b*, and 12*c* are mounted, and the wrapping film guide members 202*a*, 202*b*, and 202*c* to guide the wrapping film 10 between the wrapping rollers 12*a*, 12*b*, and 12*c* and the stacked coins 8, each of which is mounted on the roller arms 200*a*, 200*b*, or 200*c* respectively.

The cutting device 226 for cutting the wrapping film 10 is mounted on the wrapping roller arm 200*b* by the solenoid mounting plate (not shown) in the vicinity of the wrapping film guide member 202*b*. The cutting device 226 is comprised of the solenoid 98 including the rod portion 94, two springs 204, 206, a cutter 96, a cutter mounting plate 208 to which the cutter 96 is attached. The spring 204 is located above the solenoid 98 and attached at its one end to the rod portion 94. The spring 204 is connected at the other end to the spring 206 at its end in series and the spring 206 at the other end is secured to the roller arm 200*b*. Furthermore, the cutter mounting plate 208 to which the cutter 96 is attached is connected to where the spring 204 and the spring 206 are connected to each other, and therefore, the cutter mounting plate 208 is slidable so that it causes the cutter 96 to be advanced or retracted therewith. In order to limit the distance that the cutter 96 moves, the cutter mounting plate 208 has an opening 210 and the stopper pins 212, 214 engaged therewith. The solenoid 98 is comprised in such a manner that it permits the rod portion 94 to protrude the same distance every time when the solenoid advance signal is output to the solenoid driving means 116. The distance the rod portion 94 protrudes is set to the distance that is enough for the tip of the cutter 96 to abut against and cut the wrapping film wrapped around the stacked coins 8 with the smallest diameter among the denominations.

In such cutting device 226, the solenoid 98 is driven when the solenoid advance signal is output to the solenoid driving means 116 whereby the rod portion 94 is protruded. As a result, the cutter mounting plate 208 connected to where the springs 204 and 206 are connected to each other slides forward as the springs 204, 206 are stretched, whereby the cutter 96 attached to the cutter mounting plate 208 is advanced toward the stacked coins 8. Since the diameter of the coins differs among denominations, the distance between the tip of the cutter 96 at the retracted position and the wrapping film is different for each denomination. However, the solenoid 98 is comprised such that the rod portion 94 always protrude the same distance when the solenoid advance signal is output to the solenoid driving means 116. Since the distance that the rod portion 94 protrudes is set to the distance which is enough for the tip of the cutter 96 to abut against and cut the wrapping film wrapped around the stacked coins 8 with the smallest diameter among various denominations, the cutter 96 is capable of cutting the wrapping film wrapped around the stacked coins 8 with the smallest diameter among various denominations. On the other hand, when the wrapping film wrapped around the coins with a larger diameter to be cut, once the tip of the cutter 96 abuts against the wrapping film wrapped around the coins, the spring 206 is not stretched any further and only spring 204 is stretched even if the rod portion 94 protrudes further more because the cutter mounting plate 208 with the cutter 96 mounted thereon is attached to where the spring 204 and the spring 206 are connected to each other. Therefore, it is not necessary to change the distance the rod portion 94 of the solenoid 98 protrudes depending on the denomination of the wrapped coins. The spring constant of the spring 204 is selected to be larger than that of the spring 206 in order to assure to cut the wrapping film when the tip of the cutter 96 abuts against the wrapping film wrapped around the stacked coins 8.

Upon the completion of the cutting operation of the wrapping film, the solenoid retracting signal is output to the solenoid driving means 116, thereby driving the solenoid 98 and the rod portion 94 is retracted to the retracted position which causes the spring 204, 206 to shrink to the initial state. At the same time, the cutter mounting plate 208 attached to where the springs are connected to each other is slided back to the retracted position with the cutter 96 mounted thereon.

The control system and the drive system of the cutting device 226 according to the preferred embodiment are similar to those of the preferred embodiment shown in FIGS. 1 through 4. That is, when it is judged that the absolute value of the difference between the absolute position data and the reference data exceeds the allowance value, the comparing means 104 outputs a discrepancy signal to the detected data memory 100, the reference data memory 102 and the display means 114 causing the display means 114 to display that the number of coins wrapped does not coincide with the predetermined number of coins, and at the same time, outputting the activating signal to the driving pulse generator 118. Receiving the activating signal from the comparing means 104, the driving pulse generator 118 outputs the solenoid advance signal to the solenoid driving means 116. When the solenoid driving means 116 receives the solenoid advance signal from the driving pulse generator 118, it drives the solenoid 98 and causes the rod portion 94 of the solenoid 98 to protrude, whereby the spring 204 which is attached at its one end thereto and the spring 206 connected to the spring 204 at the other end in series are stretched, thereby advancing the cutter mounting plate 208 attached to where the springs 204, 206 are connected to each other. As a result, the cutter 96 attached to the cutter mounting plate 208 is also advanced and abuts against the wrapping film wrapped around the stacked coins 8. Because the stacked coins 8 wrapped with the wrapping film 10 is held and rotated by the wrapping rollers 12*a*, 12*b*, and 12*c*, the wrapping film 10 is cut along the periphery of the stacked coins 8. Furthermore, after a certain period after outputting the solenoid advance signal to the driving pulse generator 118, the comparing means 104 outputs the activating signal to the driving pulse generator 118 and cause the solenoid driving means 116 to output the solenoid retracting signal. As a result, as the solenoid 128 is driven and the rod portion 94 is retracted into the solenoid 98, the cutter mounting plate 208 attached to where the springs 204, 206 are connected to each other and the cutter 96 attached thereto are also retracted to the initial position.

According to this preferred embodiment, it is possible to provide the cutting device 226 which is capable of cutting the wrapping film wrapped around the coins without fail even when the predetermined number of coins to be wrapped is small, for example, no more than twenty coins, without any limitation in space. In other words, when the predetermined number of coins wrapped is small such as twenty coins, the height of the stacked coins 8 is low. In the previous embodiment, the cutting device 26 is located between the upper and lower claw arms 36, 38. Therefore, when there is a possibility that the upper and lower claw arms 36, 38 approach very close to each other at the time of crimping the wrapping film 10, the space available for mounting the cutting device 26 will be quite small and the cutting device 26 needs to be designed compactly. On the other hand, this preferred embodiment has greater flexibility in design due to the cutting device 226 being mounted on the wrapping roller arm 200*b*. Therefore, it is possible to provide the cutting device 226 which is capable of cutting the wrapping film 10 wrapped around the coins without any limitation in space available for mounting the cutting device 226 even when there is a possibility that the upper and lower claw arms 36, 38 approach very close to each other. In addition, according to this preferred embodiment, even when the diameter of the denomination of the coins to be wrapped changes, it is possible to cut the wrapping film 10 wrapped around the coins keeping the distance that the rod portion 94 of the solenoid 98 protrudes at constant. Furthermore, according to this preferred embodiment, since the cutter mounting plate 208 is attached to where the springs 204 and 206 are connected to each other, by its buffering effect, it is possible to prevent the wearing out and/or the damage of the tip of the cutter 96 caused by the cutter 96 being urged against the side of the stacked coins 8 with excessive force.

Figure 6:
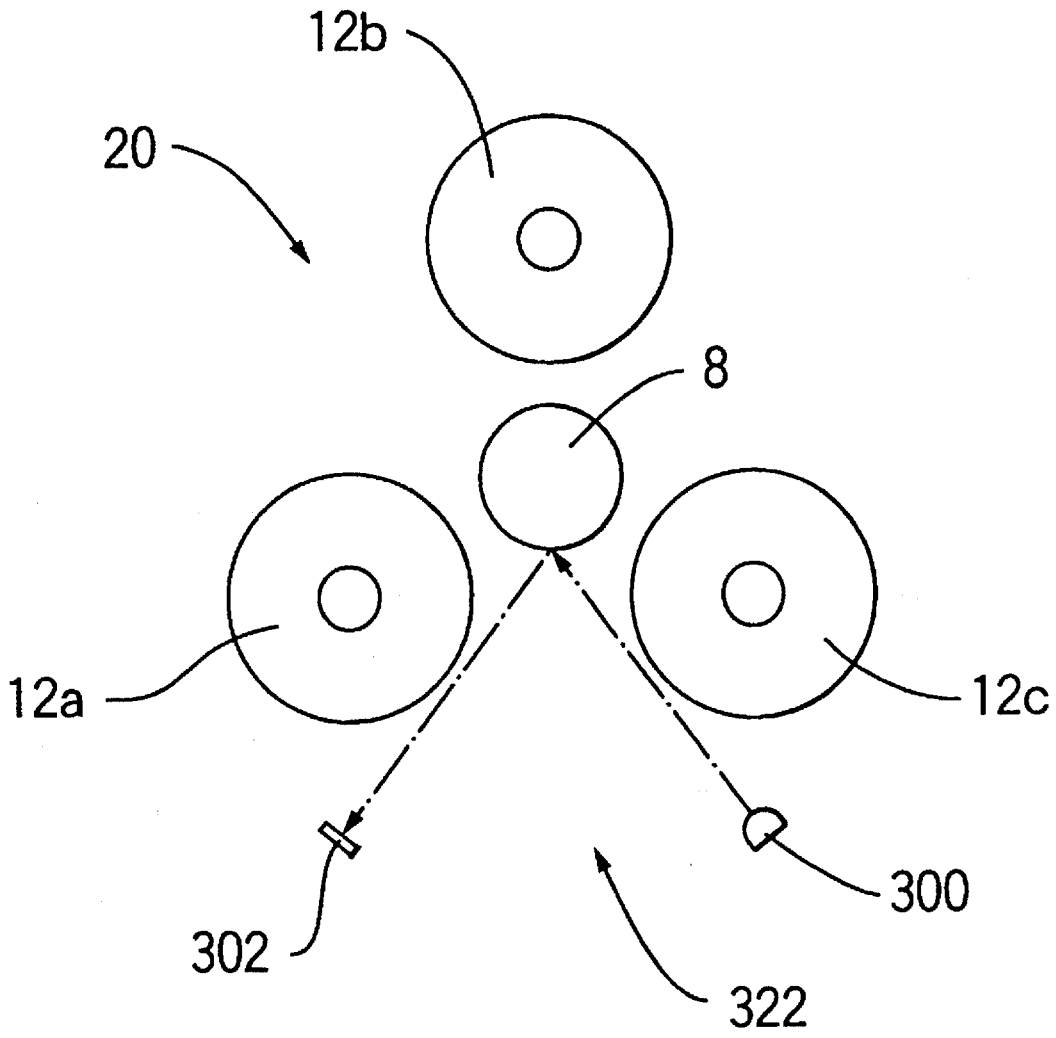
FIG. 6 is a schematic plan view showing the vicinity of a coin wrapping section of the coin wrapping apparatus which is another preferred embodiment of the present invention.

FIG. 6 is a schematic plan view showing the vicinity of a coin wrapping section of the coin wrapping apparatus which is another preferred embodiment of the present invention.

In this preferred embodiment, it is comprised in such a manner that the detection whether or not the number of coins wrapped is less than or more than the predetermined number of coins is carry out by optical means rather than detection based on the change in the relative travel distances between the upper and lower claw arms 36, 38 supporting the upper and lower crimp claws 14,16, respectively.

As shown in FIG. 6, a detecting device for detecting discrepancy in number of coins 322 in accordance with the preferred embodiment is comprised of a light emitting element 300 movable vertically along the coin wrapping section 20, a photoelectric conversion element 302 including CCD which detects the reflected light from the wrapping film 10 which was emitted by the light emitting element 300 and generates an electric detected signal that is proportional to the amount of detected reflected light.

Figure 7:
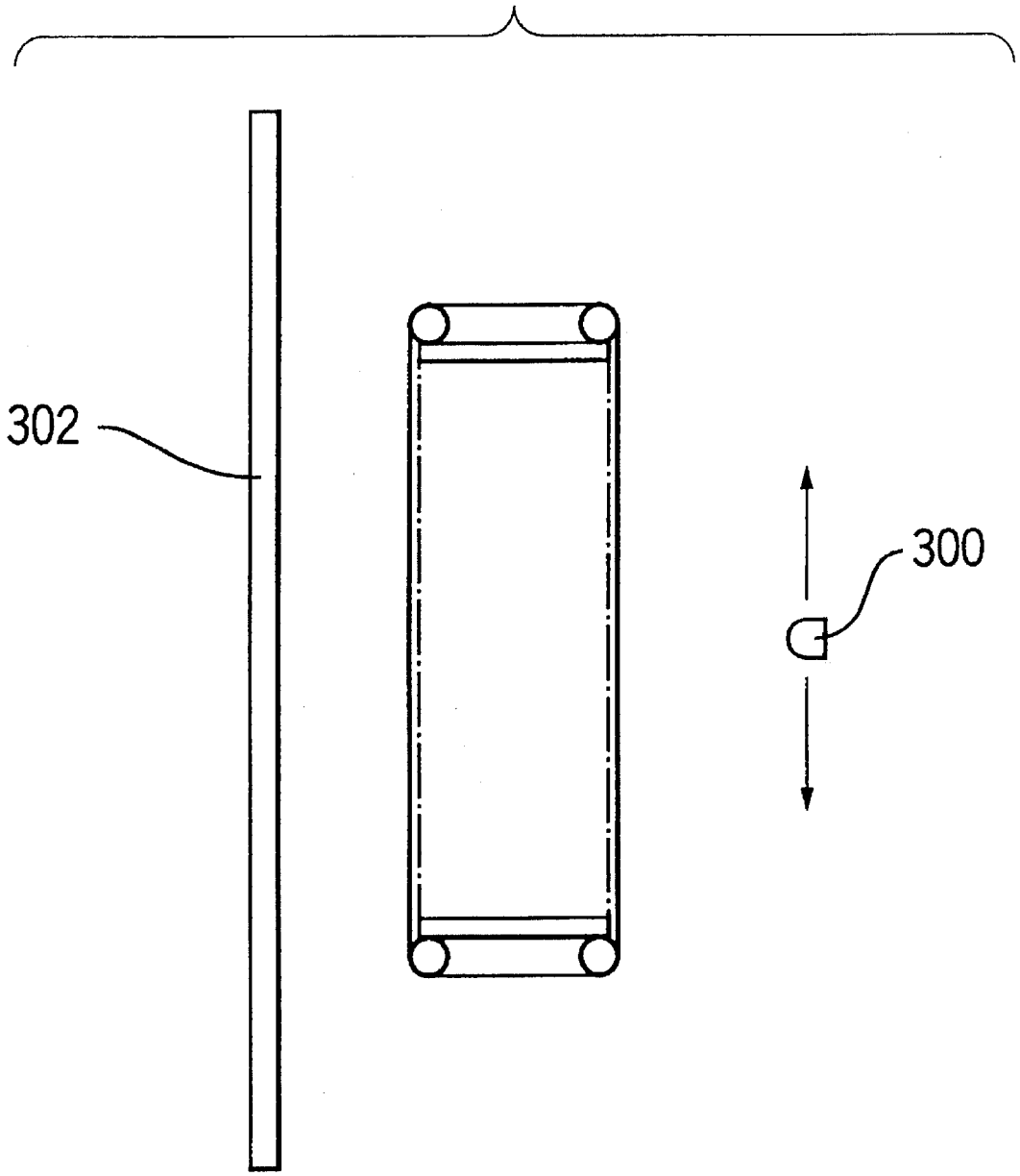
FIG. 7 is a schematic elevational view showing the relative locations among wrapped stacked coins, a light emitting element, and a photoelectric conversion element of the preferred embodiment shown in FIG. 6.

FIG. 7 is a schematic elevational view showing the relative locations among wrapped stacked coins, a light emitting element, and a photoelectric conversion element of the preferred embodiment shown in FIG. 6.

As shown in FIG. 7, the photoelectric conversion element 302 is arranged in such a manner that its range for detecting the reflected light extends vertically along the coin wrapping section 20 and extends beyond the width of the crimped wrapping film 10.

Figure 8:
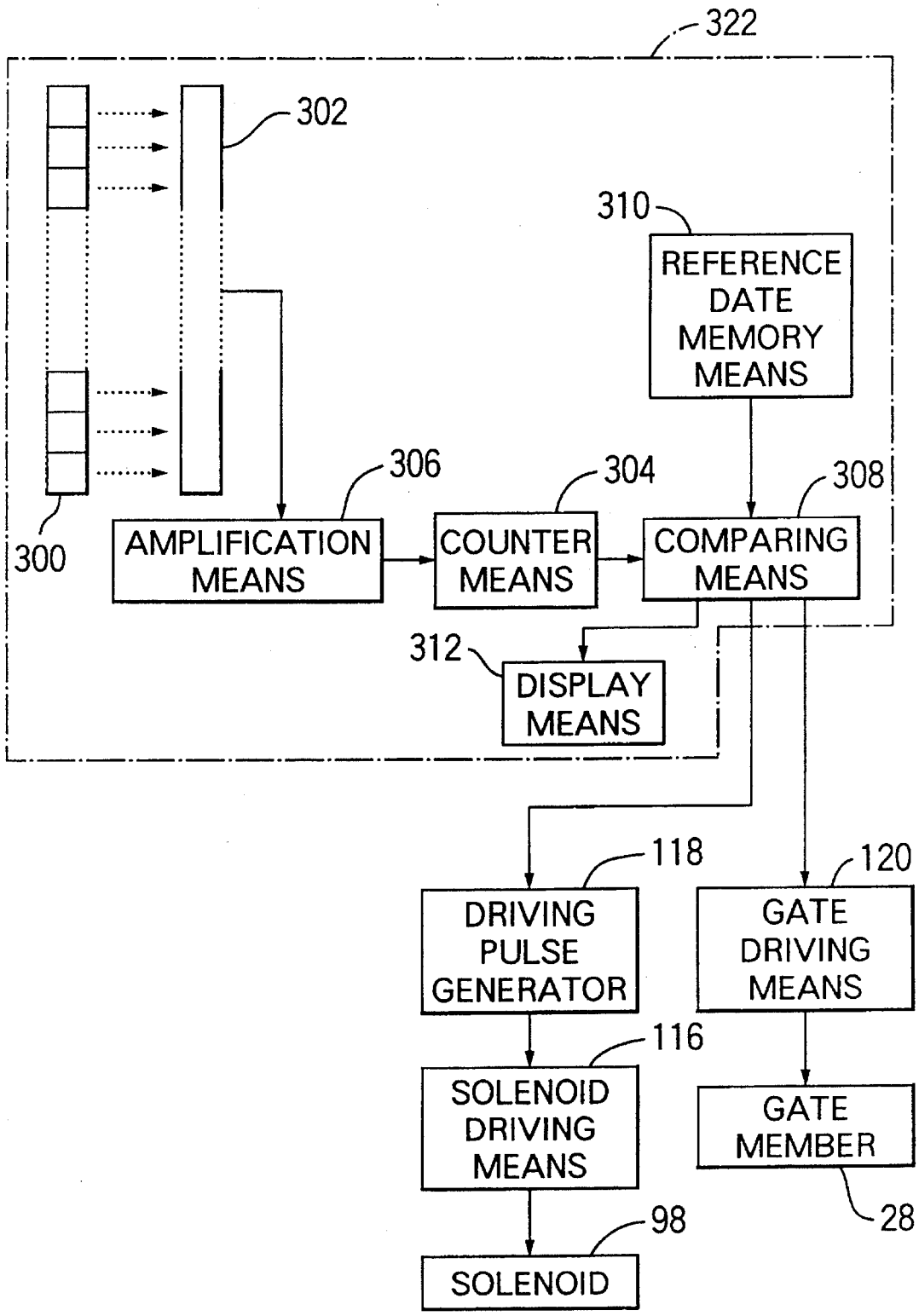
FIG. 8 is a block diagram of a control system and a judgement system of a discrepancy detecting device and a control system and an operational system of a wrapping film cutting device of the preferred embodiment shown in FIG. 6.

FIG. 8 is a block diagram of a control system and a judgement system of a discrepancy detecting device and a control system and an operational system of a wrapping film cutting device of the preferred embodiment shown in FIG. 6.

The control system and judgement system of the detecting device for detecting discrepancy in number of coins 322 are comprised of amplification means 306 for amplifying the detected signal output from the photoelectric conversion element 302, shaping the waves of the signal and outputting it to counter means 304 for counting the number of coins, the counter means 304 for counting the number of stacked coins 8 and outputs the counted value as a detected data to comparing means 308, reference data memory means 310 for storing the reference data to be compared with the detected data input from the counter means 304, the comparing means 308 for comparing the detected data input from the counter means 304 with the reference data input from the reference data memory means 310 and outputting a discrepancy signal when they do not coincide with each other, and display means 312 for displaying that the discrepancy exists in the number of wrapped stacked coins when a discrepancy signal is input from the comparing means 308.

The amplification means 306 amplifies the detected signal input from the photoelectric conversion element 302, shapes the waves of the signal and outputs the signal to the counter means 304. Because the light emitted by the light emitting element 300 is reflected nearly 100% from the side of the stacked coins 8, the amount of reflected light received by the photoelectric conversion element 302 turns out to be large for the range corresponding to the side of the coins. However, since there is a small space between the coins due to the raised and depressed portions formed on the surface of the coins, a part of the light emitted by the light emitting element 300 goes through the space therebetween without being reflected. As a result, the amount of reflected light received by the photoelectric conversion element 302 turns out to be small in the range corresponding to the space between the coins located next to each other. Therefore, the detected signal in pulse shape wave is input from the photoelectric conversion element 302 to the amplification means 306. The amplification means 306 amplifies the detected signal in pulse wave shape shaping the wave form generating a pulse signal.

Figure 9:
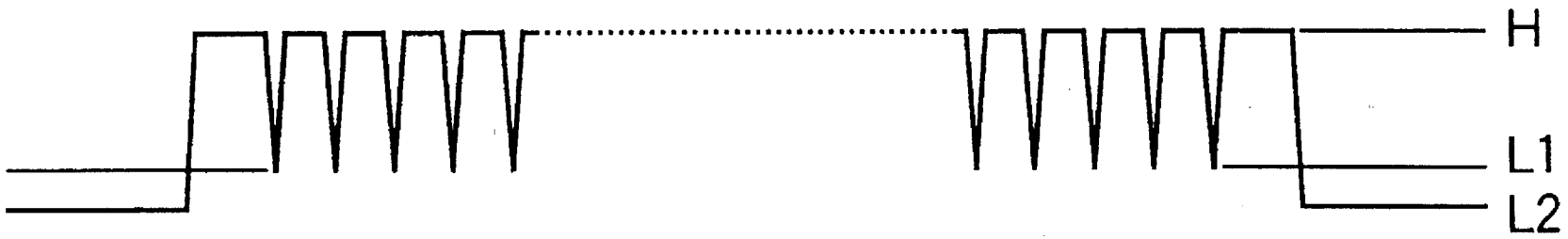
FIG. 9 is a graph showing an example of a pulse signal generated by amplifying means of the preferred embodiment shown in FIG. 6.

FIG. 9 is a graph showing an example of a pulse signal generated by amplifying means of the preferred embodiment shown in FIG. 6.

The amplification means 306 generates a clock signal based on the generated pulse signal and outputs the clock signal to the counter means 304. In FIG. 9, the level "H" corresponds to the amount of light received by the photoelectric conversion element 302 which is the reflected light from the surface of the transparent wrapping film 10 and the side of the coins that was emitted by the light emitting element 300. The level "L1" corresponds to the amount of light received by the photoelectric conversion element 302 which is the part of the light emitted by the light emitting element 302 that is reflected from the transparent wrapping film 10 while the rest of the light passes through the space between the coins. The level "L2" corresponds to the amount of light received by the photoelectric conversion element 302 in the range above and below the crimped transparent wrapping film 10 and the stacked coins 8. In the area between the coins, the part of the light emitted from the light emitting element 300 is reflected from the transparent wrapping film and is received by the photoelectric conversion element 302. However, in the range above and below the crimped transparent wrapping film and the stacked coins 8, the photoelectric conversion element 302 does not receive any reflected light since there exists no coins or wrapping film to reflect the light emitted by the light emitting element 300, and therefore, L1>L2.

Referring to FIG. 8 again, the counter means 304 counts the number of stacked coins 8 based on the ups and downs of the clock signal input from the amplification means 306 and it outputs the counted value as detected data to the comparing means 308.

Since the denomination of the coins, their total amount, the name of the financial institution, etc. are printed on the transparent wrapping film 10 wrapped around the stacked coins 8, the printed letters could have some influence on the light level reflected. However, since the wrapped stacked coins 8 is rotated by the wrapping rollers 12*a*, 12*b* and 12*c*, whereby the reflected light from the wrapped stacked coins that is detected by the photoelectric conversion element 302 is unified, it does not have much influence on the detected result. Furthermore, the wave shape of the detected signal from the photoelectric conversion element 302 is shaped by the amplification means 306. Therefore, the printed letters can not cause an error in counting the number of coins.

In the reference data memory means 310, the predetermined number of coins to be wrapped is input primarily by an operator and the number is stored as reference data. The comparing means 308 is comprised in such a manner that it compares the detected data input from the counter means 304 and the reference data read out of the reference data memory means 310. When they coincide, it outputs no signal, but on the other hand, when they do not coincide, the discrepancy signal is output to the display means 312. When the discrepancy signal is input from the comparing means 308, the display means 312 notifies the operator, for example, by sounding an alarm or displaying the fact that they do not coincide by the display means (not shown).

For the cutting device of this preferred embodiment, either one of the cutting device 226 illustrated in FIGS. 2 and 3 or the cutting device 226 illustrated in FIG. 5 can be used and, in either case, the control system and the drive system are the same as those shown in FIG. 4.

In this preferred embodiment, not like the detecting device for detecting discrepancy in number of coins 22 shown in FIGS. 1 through 5 where the discrepancy in the number of wrapped coins is detected by detecting the change in the relative travel distances between the upper claw arm 36 and the lower claw arm 38, the discrepancy in the number of coins is detected optically. When it is detected that the discrepancy exists, the wrapping film wrapped around the stacked coins 8 is cut and the coins are collected into the coin collecting box 27, and therefore, it makes it possible to distinguish the wrapped coins with more than or less than the predetermined number of coins from the wrapped rolls of stacked coins 18 with the predetermined number of coins.

The present invention has thus been shown and described with reference to specific embodiments. However, it should be noted that the present invention is in no way limited to the details of the described arrangements but changes and modifications may be made without departing from the scope of the appended claims.

For example, although, in the cutting device 26 of the preferred embodiment shown in FIGS. 1 through 3, the cutter 96 is directly attached to the rod portion 94 of the solenoid 98. However, it can be attached to the springs 204, 206 connected to each other in series as the preferred embodiment shown in FIG. 5 instead. In this case, the spring 204 located above the solenoid 98 can be connected at its one end to the rod portion 94 of the solenoid 98 and connected at the other end to the spring 206 in series. And further more, the spring 206 can be secured at the other end to the lower claw arm 38. The cutter mounting plate 208 to which the cutter 96 is attached can be mounted to where the spring 204 and the spring 206 are connected to each other.

Furthermore, in the preferred embodiment shown in FIGS. 6 through 9, the amplification means 306 generates the clock signal and outputs the signal to the counter means 304, where by the counter means 304 counts the number of wrapped stacked coins 8 based on the ups and downs of the clock signal and outputs the counted value to the comparing means 308 as the detected data. However, it may be comprised in such a manner that the height of the stacked coins 8 of the denomination to be wrapped can be stored in the reference data memory means 310 ahead of time and the amplification means 306 can amplify the detected signal from the photoelectric conversion element 302 shaping the wave shape of the signal and can output the signal to the counter means 304. The counter means for counting the number of coins 304 calculates the distance between the ranges at the level "L2", outputs the calculated value to the comparing means 308 by which the calculated value is compared with the reference data and judges whether the number of coins wrapped is less than or more than the predetermined number of coins.

In the preferred embodiment shown in FIGS. 1 through 4, although the cutting device 26 is attached to the lower claw arm 38, it can be attached to the upper claw arm 36 instead.

Furthermore, in the preferred embodiments stated above, the detecting device for detecting discrepancy in number of coins 22 detects whether or not the predetermined number of coins are wrapped based on the relative travel distances between the upper and lower crimp claws 14, 16 at the time of crimping the wrapping film, or it is carried out optically. However, it may be detected, for example, based on the absolute value of the travel distances of the upper crimp claw 14 or the lower crimp claw 16 at the time of crimping the wrapping film.

Futhermore, in the preferred embodiment shown in FIGS. 6 through 9, the light emitting element 300 which is movable vertically along the coin wrapping section 20 is used. However, the light emitting element 300 which extends vertically and is longer than the crimped width of the wrapping film 10 which emits the light to the wrapped stacked coins 8 beyond the length thereof may be used instead.

In the preferred embodiment shown in FIGS. 6 through 9, although the transparent plastic film is used for the wrapping film 10, a semitransparent wrapping film 10 can be used provided that the difference between the amount of light reflected from the side of the stacked coins 8 and that of the wrapped film 10, that is between "H" and "L1", can be distinguished.

In the preferred embodiment shown in FIGS. 6 through 9, the photoelectric conversion element 302 detects the difference in the amount of light reflected from the stacked coins 8 wrapped with the wrapping film 10. However, the amount of light passing through the space between the stacked coins 8 can be detected by the photoelectric conversion element 302 disposed at the opposite side of the light emitting element 300 with respect to the wrapped stacked coins 8. The number of coins of the stacked coins 8 can be counted based on the detected data which is the amount of light passing through the stacked coins 8 therebetween detected by the photoelectric conversion element 302.

Furthermore, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it provides the coin wrapping apparatus which is capable of distinguishing the wrapped roll-like coins with more than or less than the predetermined number of coins from those with the predetermined number of coins.

I claim:

1. A coin wrapping apparatus, comprising:

a coin discriminating and counting means for discriminating deposited coins as to whether or not they are genuine and their denomination agrees with a predetermined one while counting the number of coins;

a coin stacking means for stacking a predetermined number of coins of predetermined denomination to be wrapped;

wrapping roller means for winding a wrapping film whose width is wider than a height of coins stacked in the coin stacking section around the stacked coins so that there remain crimp regions above and below the stacked coins;

upper crimp claw means and lower crimp claw means, movable in the vertical direction toward each other so that the stacked coins are held therebetween, for crimping the crimp regions to generate rolls of wrapped coins;

discrepancy detecting means for detecting as to whether or not the predetermined number of stacked coins are wrapped after the wrapping film is wrapped around the stacked coins by the wrapping roller means;

rolls of wrapped coins collecting means for collecting the rolls of wrapped coins;

cutting means for cutting the wrapping film when it is detected that the number of stacked coins wrapped with the wrapping film is less than or more than the predetermined number of coins;

coin collecting means for collecting the coins whose wrapping film is cut by the cutting means; and gate means for selectively delivering the coins to the wrapped rolls of coins collecting means or the coin collecting means in accordance with the detected result by the discrepancy detecting means.

2. A coin wrapping apparatus in accordance with claim 1, wherein the cutting means includes a cutter and a solenoid which advances and retracts the cutter toward the stacked coins.

3. A coin wrapping apparatus in accordance with claim 1, further comprising:

upper claw arm means for supporting the upper crimp claw means and lower claw arm means for supporting the lower crimp claw means; and wherein the cutting means is mounted on one of the upper and lower claw arm means.

4. A coin wrapping apparatus in accordance with claim 2, further comprising:

upper claw arm means for supporting the upper crimp claw means and lower claw arm means for supporting the lower crimp claw means; and wherein the cutting means is mounted on one of the upper and lower claw arm means.

5. A coin wrapping apparatus in accordance with claim 3, wherein the cutting means includes first spring means and second spring means connected to each other in series, wherein the second spring means is connected at its one end opposite to where the first and second spring means are connected to either of the upper and lower claw arm means, the first spring means is connected at its one end opposite to where the first and second spring means are connected to a rod portion of the solenoid, and the cutter is attached to where the first and second spring means are connected to each other.

6. A coin wrapping apparatus in accordance with claim 4, wherein the cutting means includes first spring means and second spring means connected to each other in series, wherein the second spring means is connected at its one end opposite to where the first and second spring means are connected to either of the upper and lower claw arm means, the first spring means is connected at its one end opposite to where the first and second spring means are connected to a rod portion of the solenoid, and the cutter is attached to where the first and second spring means are connected to each other.

7. A coin wrapping apparatus in accordance with claim 1, further comprising wrapping roller arm means for supporting the wrapping roller means; and wherein the cutting means is mounted on the wrapping roller arm means.

8. A coin wrapping apparatus in accordance with claim 2, further comprising wrapping roller arm means for supporting the wrapping roller means; and wherein the cutting means is mounted on the wrapping roller arm means.

9. A coin wrapping apparatus in accordance with claim 7, wherein the cutting means includes first spring means and second spring means connected to each other in series, wherein the second spring is connected at its one end opposite to where the first and second spring means are connected to each other to the wrapping roller arm means, wherein the first spring is connected at its one end opposite to where the first and second spring means are connected to each other to the rod portion of the solenoid, and wherein the cutter is attached to where the first and second spring means are connected to each other.

10. A coin wrapping apparatus in accordance with claim 8, wherein the cutting means includes first spring means and second spring means connected to each other in series, wherein the second spring is connected at its one end opposite to where the first and second spring means are connected to each other to the wrapping roller arm means, wherein the first spring is connected at its one end opposite to where the first and second spring means are connected to each other to the rod portion of the solenoid, and wherein the cutter is attached to where the first and second spring means are connected to each other.

11. A coin wrapping apparatus in accordance with claim 1, wherein the discrepancy detecting means detects as to whether or not the number of coins wrapped is equal to the predetermined number of coins based on the relative travel distances of the upper and lower crimp claw means.

12. A coin wrapping apparatus in accordance with claim 2, wherein the discrepancy detecting means detects as to whether or not the number of coins wrapped is equal to the predetermined number of coins based on the relative travel distances of the upper and lower crimp claw means.

13. A coin wrapping apparatus in accordance with claim 11, further comprising upper claw arm means for supporting the upper crimp claw means; and lower claw arm means for supporting the lower crimp claw means; and wherein the discrepancy detecting means includes a rack extending vertically which is fixed to one of the upper and lower claw arm means;

pinion means engageable with the rack means and rotatably mounted on the other one of the lower and upper claw arm means to which the detecting means is not fixed;

absolute type rotary encoder means, connected to the pinion means, for outputting absolute position data in accordance with the rotational position;

trigger signal output means for outputting a trigger signal when the upper and lower crimp claw means move to their crimp positions where the stacked coins can be held therebetween;

detected data memory means for taking and storing absolute position data output from the rotary encoder means and outputting the absolute position data to comparing means when the trigger signal is output from the trigger signal output means;

reference data memory means for storing reference data and outputs the reference data to the comparing means; and the comparing means for detecting a discrepancy in number of coins by comparing the absolute position data output from the detected data memory means with the reference data output from the reference data memory means.

14. A coin wrapping apparatus in accordance with claim 12, further comprising upper claw arm means for supporting the upper crimp claw means; and lower claw arm means for supporting the lower crimp claw means; and wherein the discrepancy detecting means includes a rack extending vertically which is fixed to one of the upper and lower claw arm means;

pinion means engageable with the rack means and rotatably mounted on the other one of the lower and upper claw arm means to which the detecting means is not fixed;

absolute type rotary encoder means, connected to the pinion means, for outputting absolute position data in accordance with the rotational position;

trigger signal output means for outputting a trigger signal when the upper and lower crimp claw means move to their crimp positions where the stacked coins can be held therebetween;

detected data memory means for taking and storing absolute position data output from the rotary encoder means and outputting the absolute position data to comparing means when the trigger signal is output from the trigger signal output means;

reference data memory means for storing reference data and outputs the reference data to the comparing means; and the comparing means for detecting a discrepancy in number of coins by comparing the absolute position data output from the detected data memory means with the reference data output from the reference data memory means.

15. A coin wrapping apparatus in accordance with claim 1, wherein the discrepancy detecting means includes light emitting means for emitting light toward the wrapping film wrapped around the stacked coins;

photoelectric conversion means for detecting the reflected light from the stacked coins wrapped with the wrapping film or the transmitted light through between stacked coins along the longitudinal axis of the stacked coins and outputting an electric detected signal that is proportional to the amount of detected light; and further includes counter means for outputting a detected data generated by counting the number of stacked coins based on the electric detected signal input from the photoelectric conversion means; and comparing means for detecting as to wether or not the number of stacked coins is equal to the predetermined number of coins by comparing the detected data output from the counter means and the reference data stored therein.

16. A coin wrapping apparatus in accordance with claim 3, wherein the discrepancy detecting means includes light emitting means for emitting light toward the wrapping film wrapped around the stacked coins;

photoelectric conversion means for detecting the reflected light from the stacked coins wrapped with the wrapping film or the transmitted light through between stacked coins along the longitudinal axis of the stacked coins and outputting an electric detected signal that is proportional to the amount of detected light; and further includes counter means for outputting a detected data generated by counting the number of stacked coins based on the electric detected signal input from the photoelectric conversion means; and comparing means for detecting as to wether or not the number of stacked coins is equal to the predetermined number of coins by comparing the detected data output from the counter means and the reference data stored therein.

17. A coin wrapping apparatus in accordance with claim 7, wherein the discrepancy detecting means includes light emitting means for emitting light toward the wrapping film wrapped around the stacked coins;

photoelectric conversion means for detecting the reflected light from the stacked coins wrapped with the wrapping film or the transmitted light through between stacked coins along the longitudinal axis of the stacked coins and outputting an electric detected signal that is proportional to the amount of detected light; and further includes counter means for outputting a detected data generated by counting the number of stacked coins based on the electric detected signal input from the photoelectric conversion means; and comparing means for detecting as to wether or not the number of stacked coins is equal to the predetermined number of coins by comparing the detected data output from the counter means and the reference data stored therein.

18. A coin wrapping apparatus in accordance with claim 13, further comprising solenoid driving means for driving the solenoid; and gate driving means for switching the gate means; and wherein the solenoid driving means advances the solenoid when the comparing means judges that the number of stacked coins is not equal to the predetermined number of coins while causing the gate driving means to switch the gate means to deliver the coins to the coin collecting means.

19. A coin wrapping apparatus in accordance with claim 14, further comprising solenoid driving means for driving the solenoid; and gate driving means for switching the gate means; and wherein the solenoid driving means advances the solenoid when the comparing means judges that the number of stacked coins is not equal to the predetermined number of coins while causing the gate driving means to switch the gate means to deliver the coins to the coin collecting means.

20. A coin wrapping apparatus in accordance with claim 15, further comprising solenoid driving means for driving the solenoid; and gate driving means for switching the gate means; and wherein the solenoid driving means advances the solenoid when the comparing means judges that the number of stacked coins is not equal to the predetermined number of coins while causing the gate driving means to switch the gate means to deliver the coins to the coin collecting means.

21. A coin wrapping apparatus in accordance with claim 16, further comprising solenoid driving means for driving the solenoid; and gate driving means for switching the gate means; and wherein the solenoid driving means advances the solenoid when the comparing means judges that the number of stacked coins is not equal to the predetermined number of coins while causing the gate driving means to switch the gate means to deliver the coins to the coin collecting means.

22. A coin wrapping apparatus in accordance with claim 17, further comprising solenoid driving means for driving the solenoid; and gate driving means for switching the gate means; and wherein the solenoid driving means advances the solenoid when the comparing means judges that the number of stacked coins is not equal to the predetermined number of coins while causing the gate driving means to switch the gate means to deliver the coins to the coin collecting means.

* * * * *